United States Patent [19]

Messmer

[11] 3,994,606

[45] Nov. 30, 1976

[54] LOOSE LEAF PAGE FASTENER

[76] Inventor: Robert E. Messmer, 727 NW. 4th St., Boca Raton, Fla. 33432

[22] Filed: July 28, 1975

[21] Appl. No.: 599,869

[52] U.S. Cl. ..... 402/17; 402/22

[51] Int. Cl.[2] ..... B42F 13/06

[58] Field of Search ..... 402/14, 15, 16, 17, 402/18, 19, 21, 22

[56] References Cited

UNITED STATES PATENTS

| | | | |
|---|---|---|---|
| 1,330,270 | 2/1920 | Kirchner | 402/17 |
| 2,289,949 | 7/1942 | Wisdom | 402/15 |
| 2,559,556 | 7/1951 | Ambler | 402/18 X |

FOREIGN PATENTS OR APPLICATIONS

| | | | |
|---|---|---|---|
| 72,469 | 9/1916 | Austria | 402/16 |
| 686,083 | 5/1964 | Canada | 402/15 |
| 1,129,212 | 9/1956 | France | 402/21 |
| 1,024,922 | 2/1958 | Germany | 402/17 |
| 59,846 | 5/1958 | India | 402/19 |
| 917,356 | 2/1963 | United Kingdom | 402/15 |

*Primary Examiner*—Jerome Schnall
*Attorney, Agent, or Firm*—Oltman and Flynn

[57] ABSTRACT

The present fastener for holding a stack of loose leaf pages has a base piece with easily flexible and resilient plastic prongs and a top piece with openings for passing the prongs and sliders for holding the prongs folded down on the top piece. The prongs are constructed and arranged to flex readily when released from beneath the sliders in the top piece and pages in the top of the stack are folded out. The prongs have shoulders near their outer ends for preventing the complete removal of the top piece.

2 Claims, 6 Drawing Figures

LOOSE LEAF PAGE FASTENER

BACKGROUND OF THE INVENTION

A commonly used loose leaf fastener for holding a stack of pages in a legal file folder or a business correspondence file folder is the two-piece metal "ACCO" fastener, sold by ACCO International Inc., Chicago, Ill. This fastener has a base piece with bendable prongs at its opposite ends, and a top piece with openings for receiving the prongs and sliders for holding the prongs folded down on the top piece. When a relatively thick stack of pages is held by this fastener in a file folder, it often is difficult to keep the stack open to a selected page, for example, when the user wants to read from a page somewhere toward the middle or bottom of the stack. To overcome this problem, the user may remove the top piece of the fastener and then slide all the pages in the stack above the selected page off the prongs of the base piece of the fastener, leaving the selected page exposed for reading. However, this has the disadvantage that the prong-receiving openings in the removed pages must be re-aligned before these pages can be put back in, and this often is time-consuming and troublesome.

SUMMARY OF THE INVENTION

The present invention is directed to a two-piece paper fastener having a base piece with plastic prongs that are readily flexible to permit pages in the top of the stack to be folded out from the stack and to stay folded out without tending to flop back into the stack. The flexible prongs have enlarged shoulders near their outer ends which hold the apertured top piece of the fastener against complete removal from the prongs after the prongs have been released from beneath the sliders on the top piece, so that the folded-out pages need not be re-aligned before being folded back into the stack. Instead, the flexed prongs of the fastener hold the folded-out pages aligned and retained in the fastener while they are folded out of the stack and while they are being folded back into the stack.

In the preferred embodiment, each flexible prong of the fastener has its major cross-sectional dimension (width) extending lengthwise of the base portion of the base piece at its attachment to the latter. When top pages in the stack are folded out from the stack or folded under the stack, the prongs flex longitudinally transverse to the minor cross-sectional dimension (thickness), so that the prongs exert very little resistance to being flexed and the force which they exert tending to restore themselves to their normal, unflexed position is minimal. Stated another way, the flexed prongs are substantially limp and do not tend appreciably to spring back to their unflexed condition as long as the pages remain folded over.

The top piece of the fastener has a pair of prong-receiving openings which are larger in cross-section transverse to the respective longitudinal edges of the top piece than parallel to these edges. These slits pass the shoulders on the respective prongs when the top piece is being inserted on or removed from the prongs, but they engage the shoulders when the prongs are flexed longitudinally by folding out one or more pages from the top of the stack.

After the folded-out pages have been folded back into the stack the inherent resiliency of the prongs tends to restore them to a position enabling them to be folded under the sliders on the top piece of the fastener.

A principal object of this invention is to provide a novel and improved fastener for holding a stack of loose leaf pages in a file folder or the like.

Another object of this invention is to provide such a fastener having a novel construction which enables pages in the stack to be folded out readily and to remain folded out without being completely removed from the fastener.

Another object of this invention is to provide a novel and improved loose leaf fastener comprising a pronged base piece and an apertured top piece with prong-engaging sliders, which is constructed and arranged to have the top piece separated from the base piece without being completely detached from it when pages in a stack of pages held by the fastener are folded out away from the stack.

Further objects and advantages of this invention will be apparent from the following detailed description of a presently-preferred embodiment thereof, shown in the accompanying drawing in which.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 1:
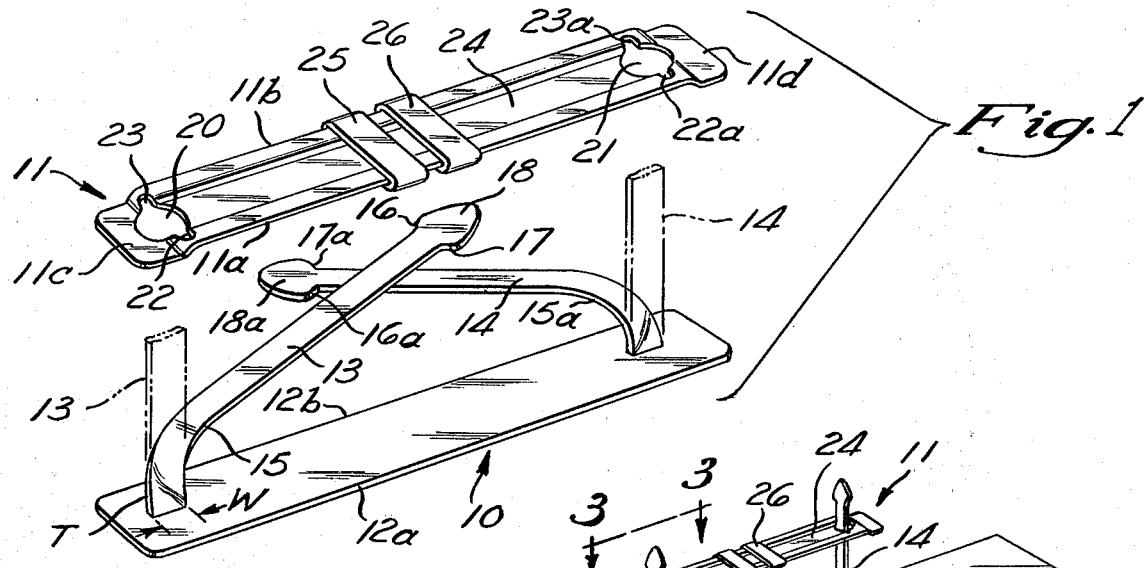
FIG. 1 is an exploded perspective view showing the pronged base piece and the apertured top piece of the present fastener disengaged from each other, with the prongs appearing in phantom as they are originally and in full lines after they have been deformed by use.

Referring to FIG. 1, the present fastener has a base piece 10 with prongs and an apertured top piece 11 removably attachable to the base piece.

The base piece comprises an elongated, generally planar, relatively rigid base portion 12 of any suitable material and a pair of elongated prongs 13 and 14 attached to the base portion 12 near its opposite ends and extending outward from the top major face of this base portion. Each prong is of manually flexible and resilient plastic material, such as polyvinyl chloride, nylon, or another suitable synthetic resin. Each prong is oblong (rectangular) in cross-section, with a width W several times its thickness T.

At its attachment to the base portion 12, the prong 13 has its width W extending longitudinally of the base portion and its much narrower thickness T extending transversely of the base portion in a direction from one longitudinal 12*a* toward the opposite longitudinal edge 12*b* of the base portion. Initially, the prong has the same configuration for its entire length outward from the base portion 12, as indicated in phantom lines in FIG. 1.

However, after use the prong may be permanently deformed to the condition shown in full lines in FIG. 1, so that it has a twist at 15. This twist extends through about one-eighth of a turn, and outward from this twist the prong extends toward the other prong 14 in a plane lying approximately parallel to the base portion 12. Throughout the length of the prong 13 outward from its twist 15, the width W of the prong extends at an angle of about 45° to the longitudinal edges 12*a* and 12*b* of the base portion 12 in a direction away from the front longitudinal edge 12*a*, and the thickness T of the prong extends approximately perpendicular to the horizontal major plane of the base portion 12. As shown in FIG. 1, the plane of the prong 13 outward from its twist 15 is not exactly parallel to the base portion 12, but is at a slight angle, diverging outwardly away from the plane of the base portion 12.

Figure 2:
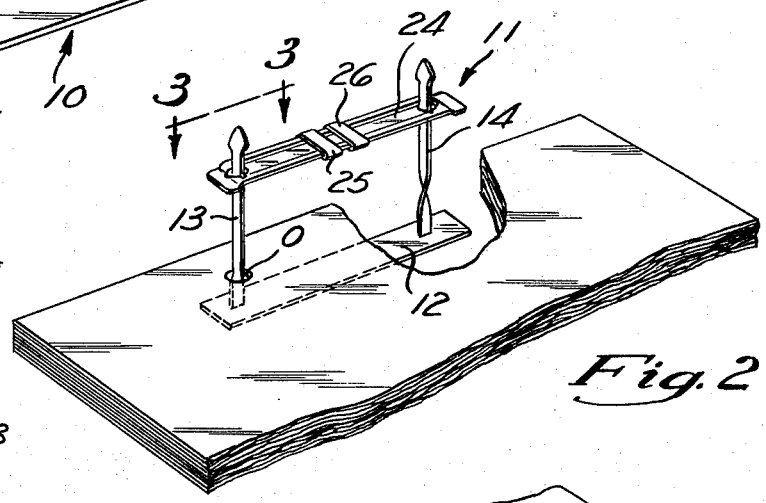
FIG. 2 is perspective view showing several pages inserted onto the pronged base piece of the fastener and the apertured top piece of the fastener being assembled to the base piece.

Near its outer, free end the prong 13 has an enlarged width and here it presents transverse, rounded shoulders 16 and 17 at its opposite side edges which face back toward the attachment of the prong to the base portion 12. At these shoulders the width of prong 13 is slightly less than the diameter of the usual circular openings O punched in the paper pages or sheets which are to be held by this fastener, as shown in FIG. 2. Beyond these shoulders the prong 13 terminates in a tapered, rounded outer end 18.

The second prong 14 is a mirror image of the first prong 13. Corresponding parts of the second prong are given the same reference numerals plus an *a* suffix, and the description of these parts will not be repeated.

The two prongs 13 and 14, having been permanently deformed by use, cross over one another at a location behind and above the rear edge 12*b* of the base portion 12 of the pronged base piece 10 of the fastener, as shown in FIG. 1.

The top piece 11 of the fastener is generally rectangular in outline and is elongated in the same direction as the base portion 12 of the base piece 10.

It has a pair of generally circular openings 20 and 21 for respectively passing the prongs 13 and 14 when the two halves of the fastener are assembled together. These openings are spaced apart longitudinally of the top piece 11 by the same distance as the spacing of the prongs 13, 14 at their attachment to the base portion 12. The opening 20 for receiving prong 13 has a pair of narrow slits 22 and 23 at diametrically opposite locations, which extend radially out from the opening toward the front and back longitudinal edges 11*a* and 11*b*, respectively, of the top piece of the fastener. Except at these slits the opening 20 is circular, and the circular diameter of the opening is less than the prong width at the shoulders 16 and 17.

The other opening 21 has the same size and shape, presenting slits 22*a* and 23*a* extending toward its front and back edges.

Figure 3:
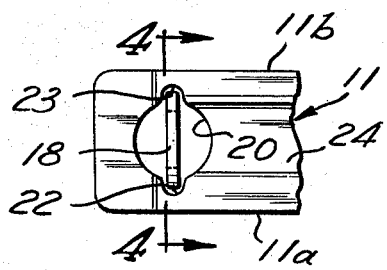
FIG. 3 is a fragmentary top plan view taken along the line 3—3 in FIG. 2 at one of the prongs of the fastener.
Figure 4:
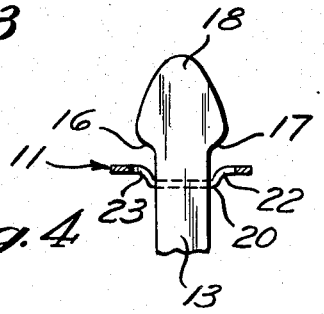
FIG. 4 is a fragmentary transverse vertical section at this prong, taken along the line 4—4 in FIG. 3.

As best seen in FIG. 3, the width of the opening 20 at the slits 22, 23 is slightly greater than the width of the corresponding prong 13 at its shoulders 16 and 17, so that the enlargement in the prong can be inserted through the opening 20 at these slits. As best seen in FIG. 2, when such insertion is made, the prong 13 is pulled up straight away from the base portion 12, and is twisted through a quarter-turn outward from its attachment to the base portion 12, so that at its outer end the width W of the prong extends substantially perpendicular to the front and back longitudinal edges 12*a* and 12*b* of the base portion 12, and its thickness T extends parallel to these edges 12*a* and 12*b*.

The same relationship exists when the second prong 14 is inserted through the second opening 21 in the top piece, at which time the shoulders 16*a* and 17*a* on this prong pass through the opening at the front and back slits 22*a* and 23*a*.

Between the openings 20 and 21 the top piece 11 is formed with a downwardly offset, longitudinally extending channel or depression 24 for receiving and locating the prongs 13 and 14 when the latter are folded down over the top piece. A pair of sliders 25 and 26 are slidable longitudinally along the top piece 11 for releasably holding the folded-down prongs 13, 14 seated in the channel 24 in the usual manner.

The opposite ends 11*c* and 11*d* of the top piece 11 are offset downwardly just beyond the slits 22, 23 and 22*a*, 23*a*, respectively, so as to extend substantially co-planar with the bottom of the depressed longitudinal channel 24 between the openings 20 and 21.

In the use of this fastener, when one or more paper pages or sheets are to be inserted, with the top piece 11 of the fastener removed from the base piece 10, the pages are inserted over the prongs 13, 14, which at this time are pulled out as shown in FIG. 2. If the pages being inserted have the usual circular punched openings O, the diameter of these openings will be slightly larger than the enlarged width of the prongs 13, 14 at the shoulders 16, 17 and 16*a*, 17*a*, respectively, so as to pass these enlargements on the prongs freely.

After the pages have been inserted onto the pronged base piece 10 of the fastener, the top piece 11 of the fastener is slipped over the prongs, as shown in FIG. 2, and pushed down against the top page in the stack. Then the prongs 13, 14 are folded over into the channel 24 in this top piece and beneath the sliders 25, 26, which hold them in place.

Figure 5:
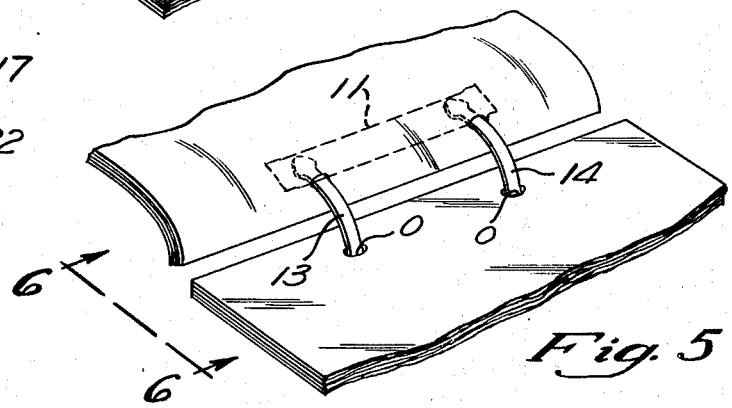
FIG. 5 is a fragmentary perspective view showing the present fastener with the stack of pages folded open to a page about half-way down.
Figure 6:
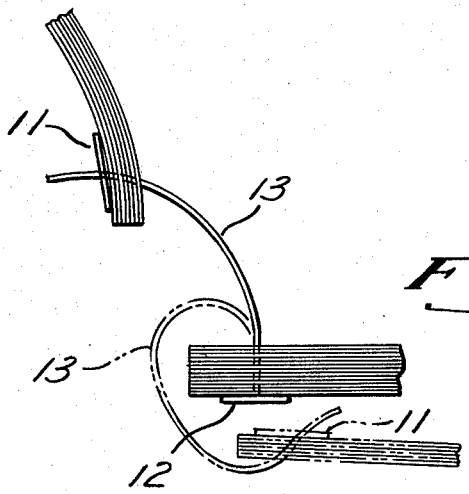
FIG. 6 is an end elevational view taken from the line 6—6 in FIG. 5 and also showing the top pages in phantom folded under the stack.

Whenever the user wants to refer more than momentarily to a particular page in the stack of pages held in this fastener, he may disengage the folded-over prongs 13, 14 from beneath the sliders 25, 26. Then the user simply flips open the stack to the particular page to which he wants to refer. When this action takes place, the top piece 11 of the fastener and the flipped-over pages slide out along the prongs 13, 14 and tend to flex these prongs longitudinally, as shown in FIGS. 5 and 6. As indicated in FIG. 5, the openings 20, 21 in the top piece 11 of the fastener catch on the shoulders 16, 17 and 16*a*, 17*a* on the flexible prongs, so that the top piece 11 and the folded-over pages do not become completely removed from the prongs because the shoulders on the latter engage the top piece 11 of the fastener on opposite sides of the openings 20, 21 in the latter in the direction longitudinally of the top piece and 90° away from the slits 22, 23 and 22*a*, 23*a*.

From FIG. 5 it will be evident that the prongs 13 and 14 are flexed longitudinally so that the width of each prong throughout its length outward from its attachment to the base portion 12 now extends parallel to the length of the base portion, and therefore in this dimension the prong does not effectively resist or oppose the deformation of the prong more-or-less arcuately along its length, as shown in FIG. 6. The flexing of each prong takes place easily because it is opposed by the prong only in its thickness dimension T which, as already mentioned, is much smaller than its width dimension. It should be understood that this easy flexing of the prongs 13 and 14 takes place automatically, simply as a result of flipping over the top pages in the stack. Just a single page need be flipped over at one time to effect this action.

If desired, the folded-out pages can be completely folded under the stack, as shown in phantom in FIG. 6, and the added flexing of the prongs 13, 14 takes place readily.

There is no appreciable tendency for the folded-out or folded-under pages to be restored to their previous position in the stack because of the fact that the prongs 13, 14 exert very little restoring force after being flexed to either full-line position or the phantom-line position in FIG. 6.

From the foregoing it will be evident that the top piece 11 of the fastener need not be completely disassembled from the pronged base piece 10 in order for the user to fold open the stack of pages to a particular page such that the folded-out or folded-under pages will not tend to flop back into the stack but will remain in their folded-out or folded-under position. Then, when the user wants to re-fasten the folded-out or folded-under pages in the stack he simply folds them back over into the stack, at which time they slide back along the prongs 13, 14 which serve as guides for keeping the openings in these pages aligned with the openings in the remaining pages in the stack.

After the previously folded-out or folded-under pages have been reassembled in the stack, the prongs 13, 14 due to their inherent resiliency tend to restore themselves to the position shown in FIG. 1, where they are ready to be folded over beneath the sliders 25, 26 on the top piece 11 of the fastener.

If desired, the prong-receiving openings in the top piece 11 of the fastener may be of elliptical or other oblong configuration, with a transverse width large enough to pass the shoulders on the respective prongs and with a size longitudinally of the top piece which is smaller than the width of the prong at the shoulders.

Also, if desired, the sliders 25, 26 may be replaced by some other means on the top piece 11 for releasably holding the prongs 13, 14 folded down on the top piece.

If desired, the plastic prongs 13, 14 may be preformed with the respective twists 15 or **15*a* in them, as shown in full lines in FIG. 1, through about one-eighth of a turn. Therefore, in its unstressed condition, as shown in FIG. 1, each prong would be about midway between the position it has when folded down into the channel 24 in the top piece and held there by the sliders 25, 26 and the position it has (FIG. 5) when pages are folded out from the stack. Only a moderate amount of force is required to deform the prongs to a position folded down into the channel 24 in the top piece 11 and, as already described, only a moderate amount of force is required to deform the prongs to the longitudinally flexed position shown in FIG. 5. However, even if not preformed with these twists 15 and 15*a*, the prongs 13, 14 may be deformed to have such twists as a result of a permanent set which develops over a period of time when the prongs are held folded down beneath the sliders 25, 26**.

I claim:

1. In a fastener for holding a stack of loose leaf pages, each having a pair of openings near one edge, said fastener having:

a base piece with an elongated base portion and a pair of elongated prongs fixedly attached to said base portion at spaced locations along the latter's length and extending outward from the base portion for insertion through said openings in the pages;

and an elongated top piece having a pair of longitudinally spaced openings for passing said prongs, a longitudinal channel on top between said openings for receiving the prongs folded down on said top piece, and sliders for holding the prongs folded down in said channel on the top piece;

the improvement wherein:

each of said prongs is of manually flexible and resilient material, is oblong in cross-section with a width several times its thickness, and has a substantially uniform thickness throughout its extent;

each prong at its attachment to said base portion of the base piece has its width extending substantially longitudinally of said base portion and its thickness extending transversely of said base portion in a direction from one longitudinal edge of said base portion toward the opposite longitudinal edge, whereby the prong is easily flexible longitudinally transverse to its thickness;

each prong is twisted longitudinally through 90° and inserted through the corresponding opening in the top piece and is folded down into said channel in the top piece beneath said sliders to hold a stack of pages in the fastener;

each prong near its outer end away from said base portion has its width enlarged transversely to form shoulders engaging the top of the top piece next to the corresponding opening therein to retain the top piece assembled to the base piece of the fastener when the prongs are flexed longitudinally transverse to their thickness, after being disengaged from beneath said sliders on the top piece, by the slidable displacement of one or more pages in the top of the stack outward along the prongs to a folded-out position;

each opening in said top piece is wider transversely of the top piece than the width of the corresponding prongs at said shoulders whereby to pass said shoulders when the top piece is inserted onto said prongs; and each opening in said top piece is smaller longitudinally of the top piece than the width of the corresponding prongs at said shoulders, whereby said shoulders engage the top of said top piece when the prongs are flexed longitudinally transverse to their thickness.

2. A fastener according to claim 1, wherein each prong is substantially rectangular in cross-section, with flat opposite major faces extending across its width, and narrower flat opposite edges extending across its thickness from one major face to the opposite major face.

* * * * *